US009068400B2

(12) United States Patent
Wiercigroch

(10) Patent No.: US 9,068,400 B2
(45) **Date of Patent: *Jun. 30, 2015**

(54) RESONANCE ENHANCED ROTARY DRILLING

(75) Inventor: Marian Wiercigroch, Aberdeen (GB)

(73) Assignee: ITI Scotland Limited, Glasgow (GB)

( * ) Notice: Subject to any disclaimer, the term of this patent is extended or adjusted under 35 U.S.C. 154(b) by 656 days.

This patent is subject to a terminal disclaimer.

(21) Appl. No.: 13/496,325

(22) PCT Filed: Sep. 8, 2010

(86) PCT No.: PCT/EP2010/063195

§ 371 (c)(1),
(2), (4) Date: May 29, 2012

(87) PCT Pub. No.: WO2011/032874

PCT Pub. Date: Mar. 24, 2011

(65) Prior Publication Data

US 2012/0241219 A1 Sep. 27, 2012

(30) Foreign Application Priority Data

Sep. 16, 2009 (GB) ..... 0916265.2

(51) Int. Cl.
*E21B 7/24* (2006.01)
*E21B 28/00* (2006.01)

(52) U.S. Cl.
CPC .. *E21B 7/24* (2013.01); *E21B 28/00* (2013.01)

(58) Field of Classification Search
CPC ..... E21B 7/24
USPC ..... 175/56, 50
See application file for complete search history.

(56) References Cited

U.S. PATENT DOCUMENTS 3,532,174 A 10/1970 Diamantides et al.
3,990,522 A 11/1976 Pyles et al.

(Continued)

FOREIGN PATENT DOCUMENTS

CN 101490358 A 7/2009
FR 2790511 A1 9/2000

(Continued)

OTHER PUBLICATIONS

Cornfield, Joe, Search Report Under Section 17, Application No. GB0916265.2, Nov. 27, 2009.

(Continued)

*Primary Examiner* — Giovanna C Wright
(74) *Attorney, Agent, or Firm* — Joseph R. Baker, Jr.; Gavrilovich, Dodd & Lindsey, LLP

(57) ABSTRACT

A method for controlling a resonance enhanced rotary drill comprising a rotary drill bit and an oscillator for applying axial oscillatory loading to the rotary drill bit, the method comprising:

controlling frequency (f) of the oscillator in the resonance enhanced rotary drill whereby the frequency (f) is maintained in the range $$(D^2 U_s/(8000\,\pi Am))^{1/2} \leq f \leq S_f(D^2 U_s/(8000\,\pi Am))^{1/2}$$

where D is diameter of the rotary drill bit, $U_s$ is compressive strength of material being drilled, A is amplitude of vibration, m is vibrating mass, and $S_f$ is a scaling factor greater than 1; and controlling dynamic force ($F_d$) of the oscillator in the resonance enhanced rotary drill whereby the dynamic force ($F_d$) is maintained in the range $$[(\pi/4)D^2_{eff}U_s] \leq F_d \leq S_{Fd}[(\pi/4)D^2_{eff}U_s]$$

where $D_{eff}$ is an effective diameter of the rotary drill bit, $U_s$ is a compressive strength of material being drilled, and $S_{Fd}$ is a scaling factor greater than 1, wherein the frequency (f) and the dynamic force ($F_d$) of the oscillator are controlled by monitoring signals representing the compressive strength ($U_s$) of the material being drilled and adjusting the frequency (f) and the dynamic force ($F_d$) of the oscillator using a closed loop real-time feedback mechanism according to changes in the compressive strength ($U_s$) of the material being drilled.

34 Claims, 3 Drawing Sheets

(56) References Cited

U.S. PATENT DOCUMENTS

| | | | | |
|---|---|---|---|---|
| 2004/0007387 | A1 | 1/2004 | Bar-Cohen et al. | |
| 2006/0225922 | A1 | 10/2006 | Pfahlert | |
| 2007/0114061 | A1* | 5/2007 | Hall et al. | 175/40 |
| 2007/0289778 | A1 | 12/2007 | Watkins et al. | |
| 2014/0116777 | A1* | 5/2014 | Wiercigroch | 175/24 |

FOREIGN PATENT DOCUMENTS

| | | | |
|---|---|---|---|
| GB | 1468387 | | 3/1977 |
| GB | 1590816 | | 6/1981 |
| WO | 2007/141550 | A1 | 12/2007 |
| WO | 2007141550 | A1 | 12/2007 |
| WO | 2008060216 | A1 | 5/2008 |

OTHER PUBLICATIONS

Morrish, Susan, International Search Report and Written Opinion, PCT/EP2010/063195, European Patent Office, Oct. 25, 2010.

Lei, Huijie, Chinese Patent Application No. 201080043909.5, Chinese Patent Office, Dec. 10, 2013.

* cited by examiner

RESONANCE ENHANCED ROTARY DRILLING

CROSS REFERENCE TO RELATED APPLICATIONS

This application is a National Stage Application filed under 35 U.S.C. §371 and claims priority to International Application Serial No. PCT/EP2010/063195, filed Sep. 8, 2010, which application claims priority to Great Britain Application No. 0916265.2, filed Sep. 16, 2009, the disclosures of which are incorporated herein by reference.

FIELD OF INVENTION

The present invention relates to percussion enhanced rotary drilling and in particular to resonance enhanced rotary drilling. Embodiments of the invention are directed to methods and apparatus for controlling resonance enhanced rotary drilling to improve drilling performance. Further embodiments described herein are directed to resonance enhanced rotary drilling equipment which may be controllable according to these methods and apparatus. Certain embodiments of the invention are applicable to any size of drill or material to be drilled. Certain more specific embodiments are directed at drilling through rock formations, particularly those of variable composition, which may be encountered in deep-hole drilling applications in the oil, gas and mining industries.

BACKGROUND OF INVENTION

Percussion enhanced rotary drilling is known per se. A percussion enhanced rotary drill comprises a rotary drill bit and an oscillator for applying oscillatory loading to the rotary drill bit. The oscillator provides impact forces on the material being drilled so as to break up the material which aids the rotary drill bit in cutting though the material.

Resonance enhanced rotary drilling is a special type of percussion enhanced rotary drilling in which the oscillator is vibrated at high frequency so as to achieve resonance with the material being drilled. This results in an amplification of the pressure exerted at the rotary drill bit thus increasing drilling efficiency when compared to standard percussion enhanced rotary drilling.

U.S. Pat. No. 3,990,522 discloses a percussion enhanced rotary drill which uses a hydraulic hammer mounted in a rotary drill for drilling bolt holes. It is disclosed that an impacting cycle of variable stroke and frequency can be applied and adjusted to the natural frequency of the material being drilled to produce an amplification of the pressure exerted at the tip of the drill bit. A servovalve maintains percussion control, and in turn, is controlled by an operator through an electronic control module connected to the servovalve by an electric conductor. The operator can selectively vary the percussion frequency from 0 to 2500 cycles per minute (i.e. 0 to 42 Hz) and selectively vary the stroke of the drill bit from 0 to ⅛ inch (i.e. 0 to 3.175 mm) by controlling the flow of pressurized fluid to and from an actuator. It is described that by selecting a percussion stroke having a frequency that is equal to the natural or resonant frequency of the rock strata being drilled, the energy stored in the rock strata by the percussion forces will result in amplification of the pressure exerted at the tip of the drill bit such that the solid material will collapse and dislodge and permit drill rates in the range 3 to 4 feet per minute.

There are several problems which have been identified with the aforementioned arrangement and which are discussed below.

High frequencies are not attainable using the apparatus of U.S. Pat. No. 3,990,522 which uses a relatively low frequency hydraulic oscillator. Accordingly, although U.S. Pat. No. 3,990,522 discusses the possibility of resonance, it would appear that the low frequencies attainable by its oscillator are insufficient to achieve resonance enhanced drilling through many hard materials.

Regardless of the frequency issue discussed above, resonance cannot easily be achieved and maintained in any case using the arrangement of U.S. Pat. No. 3,990,522, particularly if the drill passes through different materials having different resonance characteristics. This is because control of the percussive frequency and stroke in the arrangement of U.S. Pat. No. 3,990,522 is achieved manually by an operator. As such, it is difficult to control the apparatus to continuously adjust the frequency and stroke of percussion forces to maintain resonance as the drill passes through materials of differing type. This may not be such a major problem for drilling shallow bolt holes as described in U.S. Pat. No. 3,990,522. An operator can merely select a suitable frequency and stroke for the material in which a bolt hole is to be drilled and then operate the drill. However, the problem is exacerbated for deep-drilling through many different layers of rock. An operator located above a deep-drilled hole cannot see what type of rock is being drilled through and cannot readily achieve and maintain resonance as the drill passes from one rock type to another, particularly in regions where the rock type changes frequently.

Some of the aforementioned problems have been solved by the present inventor as described in WO 2007/141550. WO 2007/141550 describes a resonance enhanced rotary drill comprising an automated feedback and control mechanism which can continuously adjust the frequency and stroke of percussion forces to maintain resonance as a drill passes through rocks of differing type. The drill is provided with an adjustment means which is responsive to conditions of the material through which the drill is passing and a control means in a downhole location which includes sensors for taking downhole measurements of material characteristics whereby the apparatus is operable downhole under closed loop real-time control.

Despite the solutions described in WO 2007/141550, there is a desire to make further improvements to the methods and apparatus described therein. It is an aim of embodiments of the present invention to make such improvements in order to increase drilling efficiency while limiting wear and tear on the apparatus so as to increase the lifetime of the apparatus. It is a further aim to more precisely control resonance enhanced drilling, particularly when drilling through rapidly changing rock types.

SUMMARY OF INVENTION

Although it is evident that resonance enhanced drilling is effected by a large number of parameters, both of the material to be drilled and of the drill itself, the present inventor has realized that some parameters are more important than others and that it is advantageous to operate a resonance enhanced rotary drill within certain ranges of these important parameters to improve upon previously described arrangements whatever the size of the drill or the material being drilled.

Parameters which effect the performance of a resonance enhanced rotary drill include: diameter of the drill bit; static force on the drill bit; rotary speed of the drill bit; compressive strength of the material being drilled; mass of the oscillator, amplitude of oscillation; dynamic force of the oscillator; frequency of the oscillator; and power required to drive the rotary drill bit and the oscillator.

Of all these parameters, it has been identified that two critical parameters for controlling the oscillator in order to achieve and maintain resonance are the frequency of the oscillator and the dynamic force imparted on the rotary drill by the oscillator.

In light of the above, the present inventor has devised a method for resonance enhanced rotary drilling defined in terms of preferred operational ranges for the frequency of the oscillator and the dynamic force imparted by the oscillator on the rotary drill.

According to a first aspect of the present invention there is provided a method for controlling a resonance enhanced rotary drill comprising a rotary drill bit and an oscillator for applying axial oscillatory loading to the rotary drill bit, the method comprising:

controlling frequency (f) of the oscillator in the resonance enhanced rotary drill whereby the frequency (f) is maintained in the range $$(D^2 U_s/(8000\,\pi Am))^{1/2} \leq f \leq S_f (D^2 U_s/(8000\,\pi Am))^{1/2}$$

where D is diameter of the rotary drill bit, $U_s$ is compressive strength of material being drilled, A is amplitude of vibration, m is vibrating mass, and $S_f$ is a scaling factor greater than 1; and controlling dynamic force ($F_d$) of the oscillator in the resonance enhanced rotary drill whereby the dynamic force ($F_d$) is maintained in the range $$[(\pi/4)D^2_{eff}U_s] \leq F_d \leq S_{Fd}[(\pi/4)D^2_{eff}U_s]$$

where $D_{eff}$ is an effective diameter of the rotary drill bit, $U_s$ is a compressive strength of material being drilled, and $S_{Fd}$ is a scaling factor greater than 1, wherein the frequency (f) and the dynamic force ($F_d$) of the oscillator are controlled by monitoring signals representing the compressive strength ($U_s$) of the material being drilled and adjusting the frequency (f) and the dynamic force ($F_d$) of the oscillator using a closed loop real-time feedback mechanism according to changes in the compressive strength ($U_s$) of the material being drilled.

The aforementioned aspect of the present invention comprises an advantageous relationship between operational parameters of a resonance enhanced rotary drill to control resonance enhanced drilling for any size of drill or material to be drilled. Details as to why the defined ranges are advantageous are given in the detailed description along with a description of preferred embodiments.

According to a second aspect of the present invention there is provided an apparatus comprising a controller configured to perform the method of the first aspect. For example, the apparatus may comprise a processor, or a group of processors, suitably programmed to perform the method. Required operational parameters may be stored in a memory coupled to the processor or group of processors. The apparatus may comprise suitable hardware and/or wiring for attachment to an oscillator and for attachment to one or more sensors to produce a resonance enhanced rotary drill. For example, the apparatus may be provided as a control module with suitable inputs and outputs for insertion into a circuit between the sensors and the oscillator.

The control module may comprise a power supply and/or a suitable input for receiving power supplied from a separate power supply unit. The power necessary for driving the control module and/or the oscillator may be generated downhole. According to another aspect of the present invention, drilling fluid is used as a source of energy. High pressure fluid flow can be used to generate the necessary power. Commercially available mud motors or turbines are mainly used to generate the necessary power for the rotation of the drill-bit. Such mud motors or turbines can also be utilized to generate electricity in order to drive the oscillator. Using the mechanism (mud motor or turbine) which drives the rotary motion in order to generate electricity to drive the oscillator of a resonance enhanced rotary drill can negate the requirement for a separate power source for the oscillator making the downhole apparatus more compact. Commercially available mechanisms such as mud motors or turbines suitable for downhole use can supply power in a range up to 200 kW. Accordingly, depending on power conversion efficiency, the oscillator may have a power consumption in the range 1 to 200 kW, 1 to 150 kW, 1 to 100 kW, or 1 to 50 kW.

When suitably integrated into a resonance enhanced rotary drill, the apparatus comprises: an oscillator for applying axial oscillatory loading to a rotary drill bit; and one or more sensors, wherein the controller is configured to receive signals from the one or more sensors representing the compressive strength ($U_s$) of the material being drilled and adjust the frequency (f) and the dynamic force ($F_d$) of the oscillator using a closed loop real-time feedback mechanism according to changes in the compressive strength ($U_s$) of the material being drilled.

According to a third aspect of the present invention there is provided a resonance enhanced rotary drill which is suitable for use with the previously described control apparatus and method. The resonance enhanced rotary drill comprises: a rotary drill bit; and an oscillator for applying axial oscillatory loading to the rotary drill bit, wherein the oscillator comprises a piezoelectric actuator with mechanic amplification, a magnetostrictive actuator, a pneumatic actuator, or an electrically driven mechanical actuator. The present inventor has found that many types of oscillator do not provide the required force, stroke and frequency to achieve high performance resonance enhanced drilling using large scale apparatus such as that required in the oil industry. In contrast, using one of a piezoelectric actuator with mechanic amplification, a magnetostrictive actuator, a pneumatic actuator, or an electrically driven mechanical actuator can provide the required force, stroke and frequency to achieve high drilling performance through a range of rock types.

According to another aspect of the present invention there is provided a computer program configured to perform the method of the first aspect. The computer program may be provided as a computer program product for use in the previously described apparatus. For example, the program may be loaded onto a disk or chip for distribution and subsequent insertion into a resonance enhanced rotary drill according to the third aspect of the invention.

BRIEF DESCRIPTION OF THE DRAWINGS

For a better understanding of the present invention and to show how the same may be carried into effect, embodiments of the present invention will now be described by way of example only with reference to the accompanying drawings, in which.

DETAILED DESCRIPTION OF EMBODIMENTS

Figure 1:
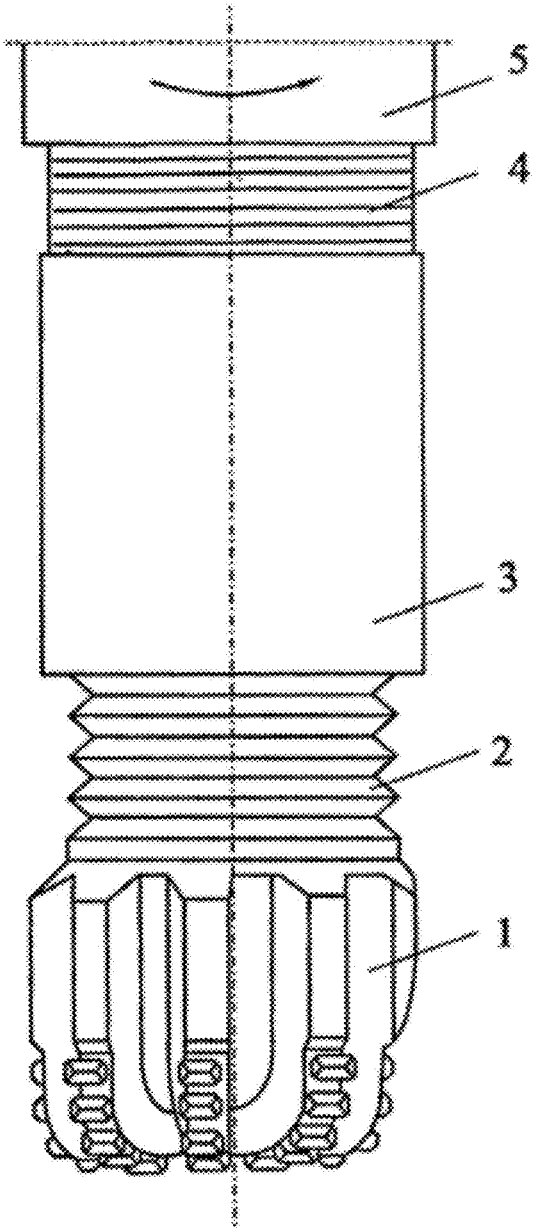
FIG. 1 shows a drilling module according to an embodiment of the present invention.

FIG. 1 shows an illustrative example of a resonance enhanced rotary drilling module according to an embodiment of the present invention. The drilling module is equipped with a rotary drill-bit 1. A vibro-transmission section 2 connects the drill-bit 1 with an oscillator 3 to transmit axially oriented vibrations from the oscillator to the drill-bit 1. A coupling 4 connects the module to a drill-string 5 and acts as a vibration isolation unit to isolate vibrations of the drilling module from the drill-string.

During a drilling operation, the rotary drill-bit is rotated and an axially oriented dynamic loading is applied to the drill-bit by the oscillator to generate a crack propagation zone to aid the rotary drill bit in cutting though material.

The oscillator is controlled in accordance with the method of the first aspect of the invention as described in the summary of invention section. The ranges for the frequency and dynamic force are based on the following analysis.

The compressive strength of the formation gives a lower bound on the necessary impact forces. The minimum required amplitude of the dynamic force has been calculated as:

$$F_d = \frac{\pi}{4} D_{eff}^2 U_s.$$

$D_{eff}$ is an effective diameter of the rotary drill bit which is the diameter D of the drill-bit scaled according to the fraction of the drill-bit which contacts the material being drilled. Thus, the effective diameter $D_{eff}$ may be defined as:

$$D_{eff} = \sqrt{S_{contact}} D,$$

where $S_{contact}$ is a scaling factor corresponding to the fraction of the drill-bit which contacts the material being drilled. For example, estimating that only 5% of the drill-bit surface is in contact with the material being drilled, an effective diameter $D_{eff}$ can be defined as:

$$D_{eff} = \sqrt{0.05} D.$$

The aforementioned calculations provide a lower bound for the dynamic force of the oscillator. Utilizing a dynamic force greater than this lower bound generates a crack propagation zone in front of the drill-bit during operation. However, if the dynamic force is too large then the crack propagation zone will extend far from the drill bit compromising borehole stability and reducing borehole quality. In addition, if the dynamic force imparted on the rotary drill by the oscillator is too large then accelerated and catastrophic tool wear and/or failure may result. Accordingly, an upper bound to the dynamic force may be defined as:

$$S_{Fd}[(\pi/4) D_{eff}^2 U_s]$$

where $S_{Fd}$ is a scaling factor greater than 1. In practice $S_{Fd}$ is selected according to the material being drilled so as to ensure that the crack propagation zone does not extend too far from the drill bit compromising borehole stability and reducing borehole quality. Furthermore, $S_{Fd}$ is selected according to the robustness of the components of the rotary drill to withstand the impact forces of the oscillator. For certain applications $S_{Fd}$ will be selected to be less than 5, preferably less than 2, more preferably less than 1.5, and most preferably less than 1.2. Low values of $S_{Fd}$ (e.g. close to 1) will provide a very tight and controlled crack propagation zone and also increase lifetime of the drilling components at the expensive of rate of propagation. As such, low values for $S_{Fd}$ are desirable when a very stable, high quality borehole is required. On the other hand, if rate of propagation is the more important consideration then a higher value for $S_{Fd}$ may be selected.

During impacts of the oscillator of period $\tau$, the velocity of the drill-bit of mass m changes by an amount $\Delta v$, due to the contact force F=F(t):

$$m\Delta v = \int_0^\tau F(t)dt,$$

where the contact force F(t) is assumed to be harmonic. The amplitude of force F(t) is advantageously higher than the force $F_d$ needed to break the material being drilled. Hence a lower bound to the change of impulse may be found as follows:

$$m\Delta v = \int_0^\tau F_d \sin\left(\frac{\pi t}{\tau}\right) dt = \frac{1}{2} U_s\ 0.05 D^2 \tau.$$

Assuming that the drill-bit performs a harmonic motion between impacts, the maximum velocity of the drill-bit is $v_m = \Delta\omega$, where A is the amplitude of the vibration, and $\omega = 2\pi f$ is its angular frequency. Assuming that the impact occurs when the drill-bit has maximum velocity $v_m$, and that the drill-bit stops during the impact, then $\Delta v = v_m = 2A\pi f$. Accordingly, the vibrating mass is expressed as $$m = \frac{0.05 D^2 U_s \tau}{4\pi f A}.$$

This expression contains $\tau$, the period of the impact. The duration of the impact is determined by many factors, including the material properties of the formation and the tool, the frequency of impacts, and other parameters. For simplicity, $\tau$ is estimated to be 1% of the time period of the vibration, that is, $\tau = 0.01/f$. This leads to a lower estimation of the frequency that can provide enough impulse for the impacts:

$$f = \sqrt{\frac{D^2 U_s}{8000\pi A m}}.$$

The necessary minimum frequency is proportional to the inverse square root of the vibration amplitude and the mass of the bit.

The aforementioned calculations provide a lower bound for the frequency of the oscillator. As with the dynamic force parameter, utilizing a frequency greater than this lower bound generates a crack propagation zone in front of the drill-bit during operation. However, if the frequency is too large then the crack propagation zone will extend far from the drill bit compromising borehole stability and reducing borehole quality. In addition, if the frequency is too large then accelerated and catastrophic tool wear and/or failure may result. Accordingly, an upper bound to the frequency may be defined as:

$$S_f(D^2 U_s/(8000\,\pi Am))^{1/2}$$

where $S_f$ is a scaling factor greater than 1. Similar considerations to those discussed above in relation to $S_{Fd}$ apply to the selection of $S_f$. Thus, for certain applications $S_f$ will be selected to be less than 5, preferably less than 2, more preferably less than 1.5, and most preferably less than 1.2.

In addition to the aforementioned considerations for operational frequency of the oscillator, it is advantageous that the frequency is maintained in a range which approaches, but does not exceed, peak resonance conditions for the material being drilled. That is, the frequency is advantageously high enough to be approaching peak resonance for the drill bit in contact with the material being drilled while being low enough to ensure that the frequency does not exceed that of the peak resonance conditions which would lead to a dramatic drop off in amplitude. Accordingly, $S_f$ is advantageously selected whereby $$f_r/S_r \leq f \leq f_r$$

where $f_r$ is a frequency corresponding to peak resonance conditions for the material being drilled and $S_r$ is a scaling factor greater than 1.

Similar considerations to those discussed above in relation to $S_{Fd}$ and $S_f$ apply to the selection of $S_r$. For certain applications $S_r$ will be selected to be less than 2, preferably less than 1.5, more preferably less than 1.2. High values of $S_r$ allow lower frequencies to be utilized which can result in a smaller crack propagation zone and a lower rate of propagation. Lower values of $S_r$ (i.e. close to 1) will constrain the frequency to a range close to the peak resonance conditions which can result in a larger crack propagation zone and a higher rate of propagation. However, if the crack propagation zone becomes too large then this may compromise borehole stability and reduce borehole quality.

One problem with drilling through materials having varied resonance characteristics is that a change in the resonance characteristics could result in the operational frequency suddenly exceeding the peak resonance conditions which would lead to a dramatic drop off in amplitude. To solve this problem it may be appropriate to select $S_f$ whereby $$f \leq (f_r - X)$$

where X is a safety factor ensuring that the frequency (f) does not exceed that of peak resonance conditions at a transition between two different materials being drilled. In such an arrangement, the frequency may be controlled so as to be maintained within a range defined by $$f_r/S_r \leq f \leq (f_r - X)$$

where the safety factor X ensures that the frequency is far enough from peak resonance conditions to avoid the operational frequency suddenly exceeding that of the peak resonance conditions on a transition from one material type to another which would lead to a dramatic drop off in amplitude.

Similarly a safety factor may be introduced for the dynamic force. For example, if a large dynamic force is being applied for a material having a large compressive strength and then a transition occurs to a material having a much lower compressive strength, this may lead to the dynamic force suddenly being much too large resulting in the crack propagation zone extend far from the drill bit compromising borehole stability and reducing borehole quality at material transitions. To solve this problem it may be appropriate to operate within the following dynamic force range:

$$F_d \leq S_{Fd}[(\pi/4)D^2_{eff}U_s - Y]$$

where Y is a safety factor ensuring that the dynamic force ($F_d$) does not exceed a limit causing catastrophic extension of cracks at a transition between two different materials being drilled. The safety factor Y ensures that the dynamic force is not too high that if a sudden transition occurs to a material which has a low compressive strength then this will not lead to catastrophic extension of the crack propagation zone compromising borehole stability.

The safety factors X and/or Y may be set according to predicted variations in material type and the speed with which the frequency and dynamic force can be changed when a change in material type is detected. That is, one or both of X and Y are preferably adjustable according to predicted variations in the compressive strength ($U_s$) of the material being drilled and speed with which the frequency (f) and dynamic force ($F_d$) can be changed when a change in the compressive strength ($U_s$) of the material being drilled is detected. Typical ranges for X include: $X > f_r/100$; $X > f_r/50$; or $X > f_r/10$. Typical ranges for Y include: $Y > S_{Fd}[(\pi/4)D^2_{eff}U_s]/100$; $Y > S_{Fd}[(\pi/4)D^2_{eff}U_s]/50$; or $Y > S_{Fd}[(\pi/4)D^2_{eff}U_s]/10$.

Embodiments which utilize these safety factors may be seen as a compromise between working at optimal operational conditions for each material of a composite strata structure and providing a smooth transition at interfaces between each layer of material to maintain borehole stability at interfaces.

The previously described embodiments of the present invention are applicable to any size of drill or material to be drilled. Certain more specific embodiments are directed at drilling through rock formations, particularly those of variable composition, which may be encountered in deep-hole drilling applications in the oil, gas and mining industries. The question remains as to what numerical values are suitable for drilling through such rock formations.

The compressive strength of rock formations has a large variation, from around $U_s$=70 MPa for sandstone up to $U_s$=230 MPa for granite. In large scale drilling applications such as in the oil industry, drill-bit diameters range from 90 to 800 mm (3½ to 32"). If only approximately 5% of the drill-bit surface is in contact with the rock formation then the lowest value for required dynamic force is calculated to be approximately 20 kN (using a 90 mm drill-bit through sandstone). Similarly, the largest value for required dynamic force is calculated to be approximately 6000 kN (using an 800 mm drill-bit through granite). As such, for drilling through rock formations the dynamic force is preferably controlled to be maintained within the range 20 to 6000 kN depending on the diameter of the drill-bit. As a large amount of power will be consumed to drive an oscillator with a dynamic force of 6000 kN it may be advantageous to utilize the invention with a mid-to-small diameter drill-bit for many applications. For example, drill-bit diameters of 90 to 400 mm result in an operational range of 20 to 1500 kN. Further narrowing the drill-bit diameter range gives preferred ranges for the dynamic force of 20 to 1000 kN, more preferably 40 to 500 kN, more preferably still 50 to 300 kN.

A lower estimate for the necessary displacement amplitude of vibration is to have a markedly larger vibration than displacements from random small scale tip bounces due to inhomogeneities in the rock formation. As such the amplitude of vibration is advantageously at least 1 mm. Accordingly, the amplitude of vibration of the oscillator may be maintained within the range 1 to 10 mm, more preferably 1 to 5 mm.

For large scale drilling equipment the vibrating mass may be of the order of 10 to 1000 kg. The feasible frequency range for such large scale drilling equipment does not stretch higher than a few hundred Hertz. As such, by selecting suitable values for the drill-bit diameter, vibrating mass and amplitude of vibration within the previously described limits, the frequency (f) of the oscillator can be controlled to be maintained in the range 100 to 500 Hz while providing sufficient dynamic force to create a crack propagation zone for a range of different rock types and being sufficiently high frequency to achieve a resonance effect.

Figure 2:
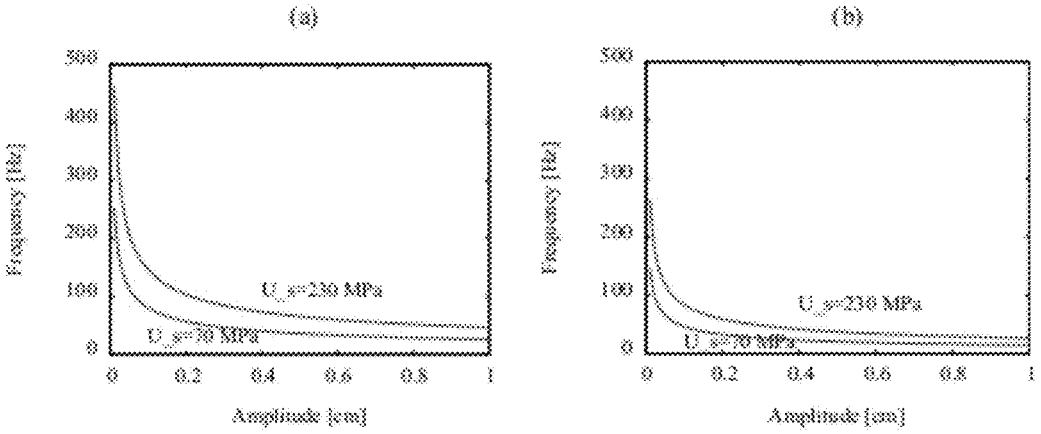
FIGS. 2(*a*) and (*b*) show graphs illustrating necessary minimum frequency as a function of vibration amplitude for various vibrational masses and various compressive strengths of material to be drilled.

FIGS. 2(*a*) and (*b*) show graphs illustrating necessary minimum frequency as a function of vibration amplitude for a drill-bit having a diameter of 150 mm. Graph (a) is for a vibrational mass m=10 kg whereas graph (b) is for a vibrational mass m=30 kg. The lower curves are valid for weaker rock formations while the upper curves are for rock with high compressive strength. As can be seen from the graphs, an operational frequency of 100 to 500 Hz in the area above the curves will provide a sufficiently high frequency to generate a crack propagation zone in all rock types using a vibrational amplitude in the range 1 to 10 mm (0.1 to 1 cm).

Figure 3:
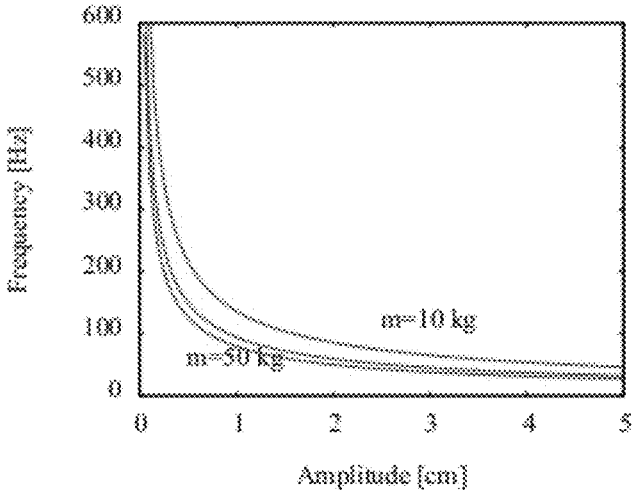
FIG. 3 shows a graph illustrating maximum applicable frequency as a function of vibration amplitude for various vibrational masses given a fixed power supply.

FIG. 3 shows a graph illustrating maximum applicable frequency as a function of vibration amplitude for various vibrational masses given a fixed power supply. The graph is calculated for a power supply of 30 kW which can be generated down hole by a mud motor or turbine used to drive the rotary motion of the drill bit. The upper curve is for a vibrating mass of 10 kg whereas the lower curve is for a vibrating mass of 50 kg. As can be seen from the graph, the frequency range of 100 to 500 Hz is accessible for a vibrational amplitude in the range 1 to 10 mm (0.1 to 1 cm).

A controller may be configured to perform the previously described method and incorporated into a resonance enhanced rotary drilling module such as that illustrated in FIG. 1. Furthermore, the resonance enhanced rotary drilling module can be provided with one or more sensors which monitor the compressive strength of the material being drilled, either directly or indirectly, and provide signals to the controller which are representative of the compressive strength of the material being drilled. The controller is configured to receive the signals from the sensors and adjust the frequency (f) and the dynamic force ($F_d$) of the oscillator using a closed loop real-time feedback mechanism according to changes in the compressive strength ($U_s$) of the material being drilled.

It may be feasible to provide a computer on the surface which processes signals from sensors down the borehole and then sends control signals back down the borehole for controlling the drill head. However, this will be difficult to achieve in practice for deep bore hole drilling as signalling between the surface and the bottom of the bore hole is not straight forward and may also be quite slow. Alternatively, it may be possible to locate the sensing, processing and control elements of the feedback mechanism down the bore hole but outside of the drill head assembly. However, in practice there may be little space down the bore hole and also the mechanism may be subjected to hash physical conditions.

Accordingly, the best arrangement for providing feedback control is to locate all the sensing, processing and control elements of the feedback mechanism within a down hole assembly, e.g. within the drill head. This arrangement is the most compact, provides faster feedback and a speedier response to changes in resonance conditions, and also allows drill heads to be manufactured with the necessary feedback control integrated therein such that the drill heads can be retro fitted to existing drill strings without requiring the whole of the drilling system to be replaced. Thus, according to one preferred arrangement there is provided a resonance enhanced rotary drill head comprising a rotary drill-bit, an oscillator, one or more sensors, a processor, and a controller, the processor arranged to receive signals from the one or more sensors, process the signals, and send one or more output signals to the controller for controlling frequency, dynamic force and/or amplitude of the oscillator. The drill head is preferably couplable to a drill string via a damping mechanism.

Figure 4:
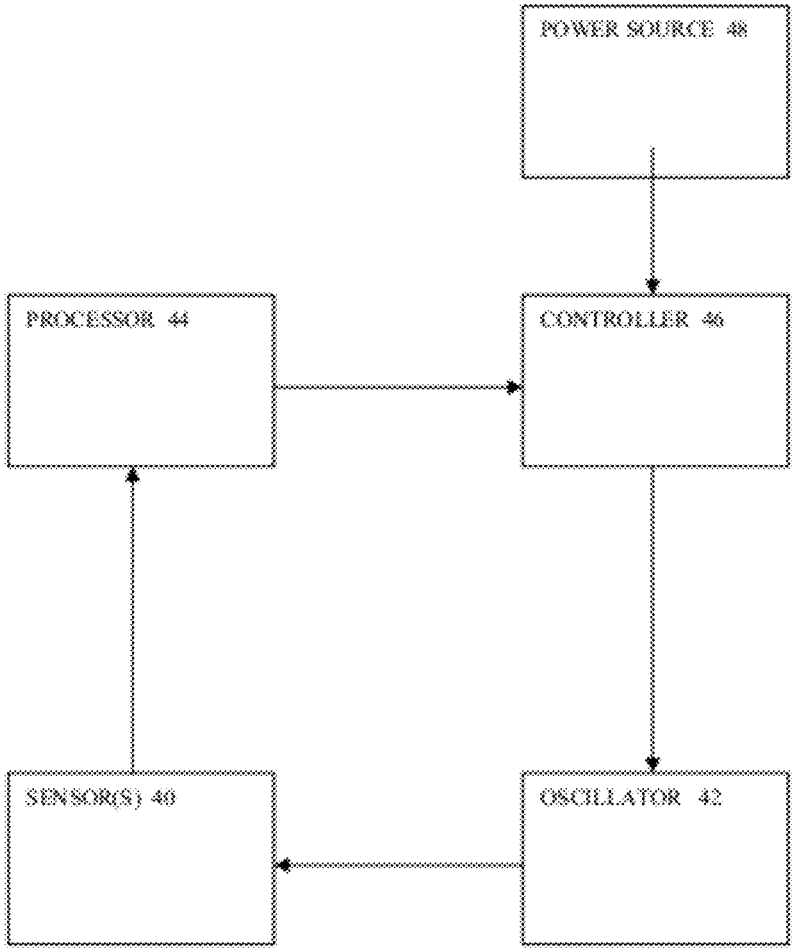
FIG. 4 shows a schematic diagram illustrating a downhole closed loop real-time feedback mechanism.

FIG. 4 shows a schematic diagram illustrating a downhole closed loop real-time feedback mechanism. One or more sensors 40 are provided to monitor the frequency and amplitude of an oscillator 42. A processor 44 is arranged to receive signals from the one or more sensors 40 and send one or more output signals to the controller 46 for controlling frequency and amplitude of the oscillator 42. A power source 48 is connected to the feedback loop. The power source 48 may be a mud motor or turbine configured to generate electricity for the feedback loop. In the figure, the power source is shown as being connected to the controller of the oscillator for providing variable power to the oscillator depending on the signals received from the processor. However, the power source could be connected to any one or more of the components in the feedback loop. Low power components such as the sensors and processor may have their own power supply in the form of a battery.

For large scale drilling equipment, the oscillator advantageously comprises a piezoelectric actuator with mechanic amplification, a magnetostrictive actuator, a pneumatic actuator, or an electrically driven mechanical actuator. It has been found that these actuators can achieved the desired frequency, dynamic force, vibrational amplitude and power consumption ranges for use with the previously described method.

Pneumatic actuators use a variation of pressure in a chamber to produce oscillatory motion. The basic setup consists of a piston inside a cylinder with two ports attached, a supply port and an exhaust port, both equipped with valves. Reciprocal motion of the piston is controlled by gas (e.g. air) supplied to the ports.

Pneumatic actuators previously used as impacting devices generally have a frequency of operation too low for use in resonance enhanced rotary drilling in accordance with certain embodiments of the present invention. However, in the case of special applications, pneumatic actuators with a much higher frequency range are available. For example, Martin Engineering produce a pneumatic rotary vibrator for use as a silo shaker to avoid the attachment of grains to the silo walls and to each other, thus improving grain flow. The vibrator utilizes an internal unbalanced mass which performs rotary motion driven by a pneumatic system to provide multiple vibrations each orbit. The bearing-free design eliminates wear problems and extends the life of the oscillator. Such an oscillator can be utilized in embodiments of the present invention.

Piezoelectricity is the ability of certain crystals to generate voltage when subjected to mechanical stress. This effect is reversible such that these materials deform when an external voltage is applied. The application of an alternating voltage results in an oscillatory motion of the piezoelectric material.

The major challenge of using a piezoelectric oscillator in embodiments of the present invention is low strain, i.e. low amplitude of vibration. This shortcoming can be overcome by mechanical amplification so as to produce displacements in excess of 1 mm. Mechanical amplification can be obtained using an external elliptical shell (e.g. made of stainless steel) which magnifies, along a short axis, the piezoelectric deformation occurring along a main axis. The elliptical frame also protects the piezoelectric against tensile force and doubles as a mechanical interface for easy integration into resonance enhanced rotary drills according to embodiments of the present invention. The elliptical frame can apply a preloading force to the piezoelectric which ensures a longer life time and better performance than traditional mechanical amplifiers based on a lever arm and flexure pivot. Such amplified piezoelectric actuators can be obtained from CEDRAT Technologies. Two or more actuators can be connected in series to increase the amplitude of vibration.

Magnetostrictive actuators work on the principle that magnetostrictive materials, when magnetised by an external magnetic field, change their inter-atomic separation to minimise total magneto-elastic energy. This results in a relatively large strain. Hence, applying an oscillating magnetic field provides in an oscillatory motion of the magnetostrictive material.

Magnetostrictive materials may be pre-stressed uniaxially so that the atomic moments are pre-aligned perpendicular to the axis. A subsequently applied strong magnetic field parallel to the axis realigns the moments parallel to the field, and this coherent rotation of the magnetic moments leads to strain and elongation of the material parallel to the field. Such magnetostrictive actuators can be obtained from MagComp and Magnetic Components AB. One particularly preferred actuator is the PEX-30 by Magnetic Components AB.

It is also envisaged that magnetic shape memory materials such as shape memory alloys may be utilized as they can offer much higher force and strains than the most commonly available magnetostrictive materials. Magnetic shape memory materials are not strictly speaking magnetostrictive. However, as they are magnetic field controlled they are to be considered as magnetostrictive actuators for the purposes of the present invention.

An electrically driven mechanical actuator can use the concept of two eccentric rotating masses to provide the needed axial vibrations. Such a vibrator module is composed of two eccentric counter-rotating masses as the source of high-frequency vibrations. The displacement provided by this arrangement can be substantial (approximately 2 mm) Suitable mechanical vibrators based on the principle of counter-rotating eccentric masses are available from Vibratechniques Ltd. One possible vibrator for certain embodiments of the present invention is the VR2510 model. This vibrator rotates the eccentric masses at 6000 rpm which corresponds to an equivalent vibration frequency of 100 Hz. The overall weight of the unit is 41 kg and the unit is capable of delivering forces up to 24.5 kN. The power consumption of the unit is 2.2 kW.

Uses of embodiments of the present invention include: well drilling, e.g. oil well drilling; mining, e.g. coal, diamond, etc. . . . ; surface drilling, e.g road works and the like; and hand-held drills, e.g. DIY drills for home use, dentists drills, etc. . . .

Advantages of embodiments of the present invention include: increased drilling speed; better borehole stability and quality; less stress on apparatus leading to longer lifetimes; and greater efficiency reducing energy costs.

While this invention has been particularly shown and described with reference to preferred embodiments, it will be understood to those skilled in the art that various changes in form and detail may be made without departing from the scope of the invention as defined by the appending claims.

The invention claimed is:

1. A method for controlling a resonance enhanced rotary drill comprising a rotary drill bit and an oscillator for applying axial oscillatory loading to the rotary drill bit, the method comprising:

controlling frequency (f) of the oscillator in the resonance enhanced rotary drill whereby the frequency (f) is maintained in the range $$(D^2 U_s/(8000\,\pi Am))^{1/2} \leq f \leq S_f (D^2 U_s/(8000\,\pi Am))^{1/2}$$

where D is diameter of the rotary drill bit, $U_s$ is compressive strength of material being drilled, A is amplitude of vibration, m is vibrating mass, and $S_f$ is a scaling factor greater than 1; and controlling dynamic force ($F_d$) of the oscillator in the resonance enhanced rotary drill whereby the dynamic force ($F_d$) is maintained in the range $$[(\pi/4)D^2_{eff}U_s] \leq F_d \leq S_{Fd}[(\pi/4)D^2_{eff}U_s]$$

where $D_{eff}$ is an effective diameter of the rotary drill bit, $U_s$ is a compressive strength of material being drilled, and $S_{Fd}$ is a scaling factor greater than 1, wherein the frequency (f) and the dynamic force ($F_d$) of the oscillator are controlled by monitoring signals representing the compressive strength ($U_s$) of the material being drilled and adjusting the frequency (f) and the dynamic force ($F_d$) of the oscillator using a closed loop real-time feedback mechanism according to changes in the compressive strength ($U_s$) of the material being drilled.

2. A method according to claim 1, wherein $S_f$ is less than 5.

3. A method according to claim 1, wherein $SF_{Fd}$ is less than 5.

4. A method according to claim 1, wherein $S_f$ is selected whereby $$f \leq f_r$$

where $f_r$ is a frequency corresponding to peak resonance conditions for the material being drilled.

5. A method according to claim 4, wherein $S_f$ is selected whereby $$f \leq (f_r - X)$$

where X is a safety factor ensuring that the frequency (f) does not exceed that of peak resonance conditions at a transition between two different materials being drilled.

6. A method according to claim 5, wherein $X > f_r/100$.

7. A method according to claim 5, wherein one or both of X and Y are adjustable according to predicted variations in the compressive strength ($U_s$) of the material being drilled and speed with which the frequency (f) and dynamic force ($F_d$) can be changed when a change in the compressive strength ($U_s$) of the material being drilled is detected.

8. A method according to claim 5, wherein $X > f^{r'}/50$.

9. A method according to claim 5, wherein $X > f_r/10$.

10. A method according to claim 1, wherein $$F_d \leq S_{Fd}[(\pi/4)D^2_{eff}U_s - Y]$$

where Y is a safety factor ensuring that the dynamic force ($F_d$) does not exceed a limit causing catastrophic extension of cracks at a transition between two different materials being drilled.

11. A method according to claim 10, wherein $Y > S_{Fd}[(\pi/4) D2_{eff}U_{s]}/100$.

12. A method according to claim 10, wherein $Y > S_{Fd}[(\pi/4) D^2_{eff}U_{s]}/50$.

13. A method according to claim 10, wherein $Y > S_{Fd}[(\pi/4) D^2_{eff}U_{s\,]}/10$.

14. A method according to claim 1, wherein the frequency (f) of the oscillator is controlled to be maintained in the range 100 to 500 Hz.

15. A method according to claim 1, wherein the dynamic force ($F_d$) is controlled to be maintained within the range 20 to 1000 kN.

16. A method according to claim 1, wherein the method further comprises controlling the amplitude of vibration of the oscillator to be maintained within the range 0.5 to 10 mm.

17. A method according to claim 1, wherein power is supplied to the oscillator from a mechanism which drives rotary motion of the drill bit.

18. A method according to claim 1, wherein the oscillator has a power consumption in the range 5 to 200 kW.

19. A method according to claim 1, wherein $S_f$ is less than 2.

20. A method according to claim 1, wherein $S_f$ is less than 1.5.

21. A method according to claim 1, wherein $S_f$ is less than 1.2.

22. A method according to claim 1, wherein $SR_{Fd}$ is less than 2.

23. A method according to claim 1, wherein $S_{Fd}$ is less than 1.5.

24. A method according to claim 1, wherein $S_{Fd}$ is less than 1.2.

25. A method according to claim 1, wherein the dynamic force ($F_d$) is controlled to be maintained within the range 40 to 500 kN.

26. A method according to claim 1, wherein the dynamic force ($F_d$) is controlled to be maintained within the range 50 to 300 kN.

27. A method according to claim 1, wherein the method further comprises controlling the amplitude of vibration of the oscillator to be maintained within the range 1 to 5 mm.

28. A method according to claim 1, wherein the oscillator has a power consumption in the range 5 to 150 kW.

29. A method according to claim 1, wherein the oscillator has a power consumption in the range 5 to 100 kW.

30. A method according to claim 1, wherein the oscillator has a power consumption in the range 5 to 50 kW.

31. An apparatus comprising a controller configured to perform the method of claim 1.

32. An apparatus according to claim 31, wherein the apparatus further comprises:

an oscillator for applying axial oscillatory loading to a rotary drill bit; and one or more sensors, wherein the controller is configured to receive signals from the one or more sensors representing the compressive strength ($U_s$) of the material being drilled and adjust the frequency (f) and the dynamic force ($F_d$) of the oscillator using a closed loop real-time feedback mechanism according to changes in the compressive strength ($U_s$) of the material being drilled.

33. An apparatus according to claim 32, wherein the oscillator comprises a piezoelectric actuator with mechanic amplification, a magnetostrictive actuator, a pneumatic actuator, or an electrically driven mechanical actuator.

34. An apparatus according to claim 32, further comprising a vibration isolation unit which is couplable to a downhole end of a drill string whereby the apparatus is operable under downhole closed loop real-time control.

* * * * *